US010458661B2

(12) United States Patent
Astolfi et al.

(10) Patent No.: US 10,458,661 B2
(45) Date of Patent: Oct. 29, 2019

(54) FAN FOR SMOKE AND VAPOR EXTRACTION SYSTEM, IN PARTICULAR FOR KITCHENS AND EXTRACTION SYSTEM INCORPORATING SUCH A FAN

(71) Applicant: Faber S.p.A., Fabriano (AN) (IT)

(72) Inventors: Ilaria Astolfi, Nocera umbra (IT); Simone Biocco, Fabriano (IT); Simone Celli, Pescara (IT); Francesco Faginoli, Fabriano (IT); Raffaele Galassi, Fossato di Vico (IT)

(73) Assignee: Faber S.p.A., Fabriano (AN) (IT)

( * ) Notice: Subject to any disclaimer, the term of this patent is extended or adjusted under 35 U.S.C. 154(b) by 17 days.

(21) Appl. No.: 15/471,535

(22) Filed: Mar. 28, 2017

(65) Prior Publication Data

US 2017/0292718 A1 Oct. 12, 2017

(30) Foreign Application Priority Data

Apr. 7, 2016 (IT) ..... 102016000035918

(51) Int. Cl.

| | |
|---|---|
| ***F24C 15/20*** | (2006.01) |
| ***F04D 13/06*** | (2006.01) |
| ***F04D 25/08*** | (2006.01) |
| ***F04D 29/22*** | (2006.01) |
| ***F04D 17/16*** | (2006.01) |
| ***F04D 29/16*** | (2006.01) |
| ***F04D 29/28*** | (2006.01) |

(Continued)

(52) U.S. Cl.

CPC ..... *F24C 15/2042* (2013.01); *F04D 13/06* (2013.01); *F04D 17/16* (2013.01); *F04D 25/08* (2013.01); *F04D 29/162* (2013.01); *F04D 29/22* (2013.01); *F04D 29/282* (2013.01); *F04D 29/30* (2013.01); *F04D 29/4226* (2013.01); *F04D 29/663* (2013.01); *F04D 29/666* (2013.01); *F05D 2250/184* (2013.01)

(58) Field of Classification Search

CPC ..... F04D 13/06; F04D 25/08; F04D 29/22; F04D 17/16; F04D 29/282; F04D 29/30; F04D 29/4226; F04D 29/663; F04D 29/666; F04D 29/162; F24C 15/2042; F24C 15/20; F05D 2250/184

USPC ..... 126/299 R, 299 D, 299 F, 300–303

See application file for complete search history.

(56) References Cited

U.S. PATENT DOCUMENTS

| | | | |
|---|---|---|---|
| 1,893,184 | A | 1/1933 | Smellie |
| 2008/0279681 | A1 | 11/2008 | Eguchi et al. |

(Continued)

FOREIGN PATENT DOCUMENTS

| | | |
|---|---|---|
| CN | 104454633 | 3/2015 |
| EP | 2365224 | 9/2011 |

(Continued)

*Primary Examiner* — Vivek K Shirsat

(74) *Attorney, Agent, or Firm* — Volpe and Koenig, P.C.

(57) ABSTRACT

A fan (1) for a smoke and/or vapor extraction system that includes an impeller (3) located within a diffuser or volute (2), the impeller (3) being driven by an electric motor (24); the impeller (3) having a body (20) having a flat part (21) from which a plurality of radially arranged blades (33) extend; these blades are separated from each other by a variable distance based on a periodic function. In addition to this, the diffuser (2) has an air delivery or discharge conduit (5) having a cross-section increasing from an inlet to its outlet (6).

7 Claims, 5 Drawing Sheets

(51) Int. Cl.

| | |
|---|---|
| ***F04D 29/30*** | (2006.01) |
| ***F04D 29/42*** | (2006.01) |
| ***F04D 29/66*** | (2006.01) |

(56) References Cited

U.S. PATENT DOCUMENTS

| | | | | |
|---|---|---|---|---|
| 2011/0052385 | A1* | 3/2011 | Duke | F04D 29/281 415/203 |
| 2013/0017078 | A1* | 1/2013 | Armstrong | F04D 29/162 415/204 |
| 2015/0260201 | A1 | 9/2015 | Hall et al. | |

FOREIGN PATENT DOCUMENTS

| | | | | |
|---|---|---|---|---|
| EP | 2365224 | A1 * | 9/2011 | F04D 17/162 |
| EP | 2546526 | | 1/2013 | |
| EP | 2778428 | | 9/2014 | |

* cited by examiner

FAN FOR SMOKE AND VAPOR EXTRACTION SYSTEM, IN PARTICULAR FOR KITCHENS AND EXTRACTION SYSTEM INCORPORATING SUCH A FAN

INCORPORATION BY REFERENCE

The following documents are incorporated herein by reference as if fully set forth: Italian Patent Application No. 102016000035918, filed Apr. 7, 2016

BACKGROUND

This invention relates to a fan for a smoke and vapour extraction system. It also relates to an extraction system provided with such a fan.

With particular reference to systems for the extraction of smoke and vapours which are generated during the preparation of food on a cooking surface (systems also indicated below as extraction hoods), these comprise a structure which can be combined below with a kitchen cabinet or which can be inserted into such a kitchen cabinet, or which may form part of the kitchen furniture itself or may be an independent structure.

Such a hood comprises a fan which extracts smoke and vapours from the cooking surface and directs them towards a discharge conduit which may open into the environment in which the surface is located or outside the said environment; in that case the discharge conduit is associated with a pipe that transfers the said smoke and vapours outside the said environment.

A normal fan for an extraction hood comprises a diffuser (or volute) containing an impeller defined by a finned body (or one with blades) associated with an electric motor and located in an opening in the diffuser through which the smoke or vapours are extracted. Close to such opening there is in the structure of the hood at least one grease-trap filter, at least one other filter which can be located in another suitable position of the diffuser when the said smoke or vapours are returned to the environment in which the cooking surface is located.

The impeller has an inlet cross-section for such smoke and vapours which may be to a greater or lesser extent close to such a filter. Although suitably and adequately performing their function in the extraction hoods available on the market, known fans have limitations and problems of various kinds.

One particularly felt problem is that of having a high volumetric throughput to quickly extract smoke from the cooking surface, having a high fan efficiency and consequently a low energy efficiency class.

The new guidelines introduced by the "energy label" for the energy efficiency of extractor units (EU Regulation 65/2014 and Ecodesign Regulation 66/2014) have resulted in companies working to increase the efficiency of existing fan systems. In the past improvements in performance were generally achieved through optimising the motors, in line with technical knowledge.

Because the overall efficiency of an extractor unit is defined as follows:

$$\eta g = \eta \int \cdot \eta m$$

where $\eta g$: overall efficiency $\eta \int$ : fluid dynamic efficiency $\eta m$: motor efficiency, given that motors have very high efficiency values at the present time, the margins for any possible improvements in overall efficiency are somewhat low.

For this reason companies are currently investing to optimise the fluid dynamic efficiency ($\eta \int$) of extractor units. At the new mould making stage fluid dynamic optimisation of the diffuser and impeller initially gives rise to greater investment costs, but these are largely recovered thanks to the fact that the costs of a mould, even one of excessive geometrical complexity, are approximately the same, regardless of any optimisation of the shapes. Instead an improvement in the performance of a motor is in most cases associated with an increase in the fixed cost of each individual component.

On the basis of the above, the aims of fluid dynamic optimisation are those of:

i) for the same motor, achieving a rise to the next higher efficiency class; and ii) for the same energy efficiency class, using a less powerful motor, which generally has a lower cost.

For fluid dynamic efficiency to be improved, action needs to be taken on the fan and its components such as the impeller and diffuser. This however often involves the construction of very complex moulds (with a high number of undercuts) to produce the components of a high efficiency fan. Consequently the costs of such moulds are very high, and this has an effect on the finished product.

Another way of increasing the efficiency or fluid dynamic performance is also to produce impellers having the particular shape which frequently give rise to dissipative energy phenomena within the diffuser, in the form of turbulent vortices, which actually reduce performance in terms of volumetric throughput, static pressure and electrical energy consumption.

Another problem which is encountered when searching to optimise the procedure for manufacturing a fan for extraction hoods is associated with the mechanics of the fan's own structure. Fans often in fact have geometries which have an adverse effect on any overall efficiency of the extraction hood due for example to the excessively small distance between the fat-trap filters located at the inlet to the hood and the extraction cross-section of the fan (or the aperture of the latter corresponding to the impeller).

In addition to this, the structure of the hood and/or the fan may have an adverse effect on cooling of the impeller's electric motor (and therefore on its efficiency) or give rise to head losses due to the presence of an extraction grid in the inlet cross-section of the impeller (associated with the diffuser) and/or other details (such as motor support, cable duct, etc.).

Known fans therefore have other disadvantages associated with the complex assembly of their components (owing to the presence of various individual parts, such as for example the motor, impeller, diffuser supporting cage, which must be attached to the diffuser itself) and large size, giving rise to the hood in which the fan is inserted being of non-negligible size.

Furthermore, again with regard to the fluid dynamic efficiency of known fans, these have an impeller with the normal configuration of double parallel discs between which blades in an inclined arrangement with respect to the radii of such discs are located. The electric motor is placed between the latter. This impeller conformation, which can be achieved through complex and relatively long production and assembly means, which are therefore of more than negligible cost, results in the presence in the diffuser of at least one internal crown (which guides the flow of air to the outlet from the diffuser) having an adverse effect on the energy of the outgoing air flow and giving rise to dissipative energy phenomena in the form of turbulent vortices created between the blades of the impeller and such crown. This reduces the performance of the fan in terms of volumetric throughput and static pressure.

For the above-mentioned reasons there is also an increase in the noise level of the fan. Such noise is also due to the distribution of blades in the impeller, and in particular the distribution of the blades between the double discs: this distribution, often with the blades equally distant, gives rise to a tonal frequency or noise that is readily audible to human ears when the extraction system is in use, a noise which is also a nuisance and disturbs everyone located close to such a system.

US 2011/052385, U.S. Pat. No. 1,893,184 and US2015/260201 each describe a fan comprising an impeller located within a container body or diffuser driven by its own actuator; the impeller has blades arranged radially and spaced apart in a non-uniform manner. This makes it possible to reduce the noise from the fan when in use.

The abovementioned priorities also describe or illustrate a diffuser having an increasing diameter in a plane cutting through it at right angles to the axis of rotation of the impeller. However a cross-section in a plane containing that axis always has the same dimensions all along the diffuser and at least from the inlet to a delivery conduit from the diffuser to its outlet. This gives rise to the possibility of head losses, which have an effect on fluid dynamic efficiency and therefore an overall effect on the fan.

At least US2011/052385 and U.S. Pat. No. 1,893,184 show prior art that form the starting point for the improvements of the present invention.

SUMMARY

The object of this invention is to provide a fan for a smoke and vapour extraction system which is improved in comparison with similar known fans.

In particular the object of the invention is to provide a fan of the type mentioned which makes it possible to increase the fluid dynamic efficiency of the extraction system and therefore its overall performance, and therefore makes it possible to achieve a higher energy class for the fan, for the same motor performance.

Another object is to provide a fan which has a smaller number of components than known fans and is therefore easier to construct and assemble in comparison with the latter and has a lower cost in comparison with known solutions.

A further object is that of providing a fan in which the internal air flow is optimised to reduce head losses and noise during operation.

Another object is to provide an extraction system with an improved fan that is very silent.

These and other objects which will be apparent to those skilled in the art will be achieved through a fan and an extraction system having one or more features of the invention.

BRIEF DESCRIPTION OF THE DRAWINGS

For a better understanding of this invention there are appended purely by way of example, but without any limitation, the following drawings in which.

DETAILED DESCRIPTION OF THE PREFERRED EMBODIMENTS

Figure 5:
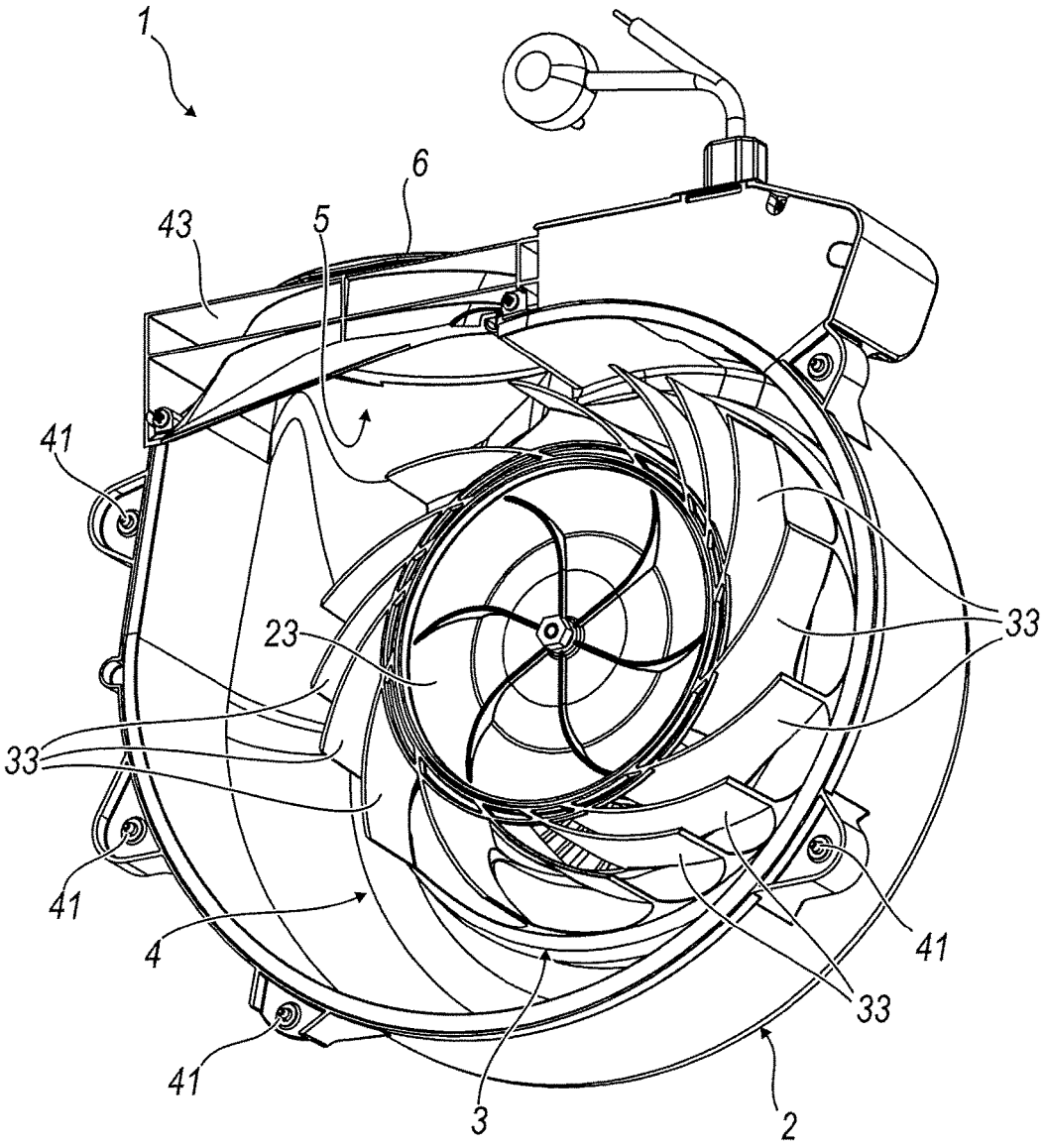
FIG. 5 shows a perspective view of another side of the fan in FIG. 1.

With reference to the figures mentioned, a fan according to the invention is indicated generically by 1. This comprises a diffuser 2 and an impeller 3; in particular the diffuser has a first portion 4 containing impeller 3 (see in particular FIG. 5) and a second portion 5 (delivery conduit) which is open at a free extremity or outlet 6. First portion 4 has an opening 8 at which impeller 3 is located within diffuser 2, said opening 8 defining an extraction opening for air containing smoke and/or vapours from an area in which these form.

In one embodiment of the invention fan 1 is inserted within a kitchen extraction hood and the smoke and/or vapours are generated from a cooking surface where food is in the course of preparation. This hood may be of the type which is externally associated with a kitchen cabinet located above such cooking surface, inserted within such cabinet, a part of the cooking surface or independently attached thereto; otherwise the hood may be an independent element placed at a distance from the cooking surface.

Second portion or delivery conduit 5 of the diffuser may be attached to a conduit or pipe which carries smoke and/or vapours outside the environment in which the smoke is generated (for example the kitchen), or conduit 5 may open within such environment, in which case the smoke and/or vapours are returned after they have been suitably filtered.

Preferably there is a grease trap filter associated with a structure of the extraction hood, not shown in the figures, to which the fan is attached at opening 8 of the fan.

Between extraction opening 8 and filter there is a suitable distance (for example of 10-50 mm) to allow the flow of air to pass towards the extraction cross-section.

First portion 4 of diffuser 2 is hollow with respect to an extremity portion of diffuser 2 itself, has a wall 13 closing off the diffuser and contains impeller 3. Such impeller 3 has a body 20 having a first annular flat portion 21A delimiting a central hollow cavity 22, a second annular portion 21B, coplanar with the first and concentric therewith (and located internally within first portion 21A) and a third flat portion 23 enclosing cavity 22 in a plane P distant from plane Z in which first and second portions 21A and 21B lie.

Between first and second annular portions 21A and 21B there is therefore a through annular hollow 28 whose function will be described below.

An electric motor 24 is located within cavity 22 of impeller 3 and within first portion 4 of diffuser 2. Motor 24 is attached to enclosing wall 13 and diffuser 2 by means of screws 26.

Motor 24 has an output shaft 31 which is of one piece in any known way with impeller 3. In particular a seat 27 for attaching such shaft 31 to impeller 3 is provided in third flat portion 23 of impeller 3.

The latter has a plurality of radially arranged blades 33 of one piece with first and second portions 21A and 21B of impeller body 20. These blades are arranged at variable distances from each other; in particular such distance varies according to a periodic function such as a sinusoidal or similar function.

The words "varies according to a periodic function" means that the angular distance between each pair of blades along the edge of impeller 3 varies on passing from one blade 33 to the next and the next one again according to a non-linear mathematical function (that is, for example, what happens if the distances are constant or increase according to a linear function of the type Y=ax), but according to a variable mathematical function (law) along the inner circumference of the impeller (for example y=A sin (m·x), where m is the periodicity within the circumference, where m≥1). In other words, starting from an initial blade 33, and moving along the entire impeller, returning to such initial blade and repeating such movement several times, a function which describes the variation in the distances between the blades will be a periodic function (for example the sinusoidal function).

Thanks to this characteristic, when the impeller rotates there is produced noise whose intensity is defined by the formula $$BPF=nt/60$$

where

BPF=Blade Pass Frequency, or frequency (in Hz) of the noise generated by the movement of the rotating blades n=rotation speed (revolutions per minute)

t=number of blades.

The noise generated is very much less than that generated by the rotation of an impeller having equally spaced blades, because for the same number of blades the frequency of the noise generated is displaced into a portion of the audible spectrum where the human ear is less sensitive.

As mentioned, impeller 3 has a first flat annular portion 21A and a second flat annular portion 21B. Blades 33, of slightly arched shape, are located in an arched manner between first and second portions 21A and 21B and are of one piece therewith.

Such blades 33 are also of one piece with third portion 23 enclosing cavity 22 of the impeller (which thus has a substantially recessed shape, but project laterally to such portion 23 being attached to first and second portions 21A and 21B.

In this way portion 23 is "supported" by blades 33 (of one piece with portion 21) at a distance from such first portion 21.

Impeller 3 is located in first portion 4 of the diffuser and rotates substantially within aforesaid first portion 4 which is recessed with respect to a perimetral part 40 having points 41 at which such first portion 4 is attached to the structure of the extraction hood (not shown).

Figure 2:
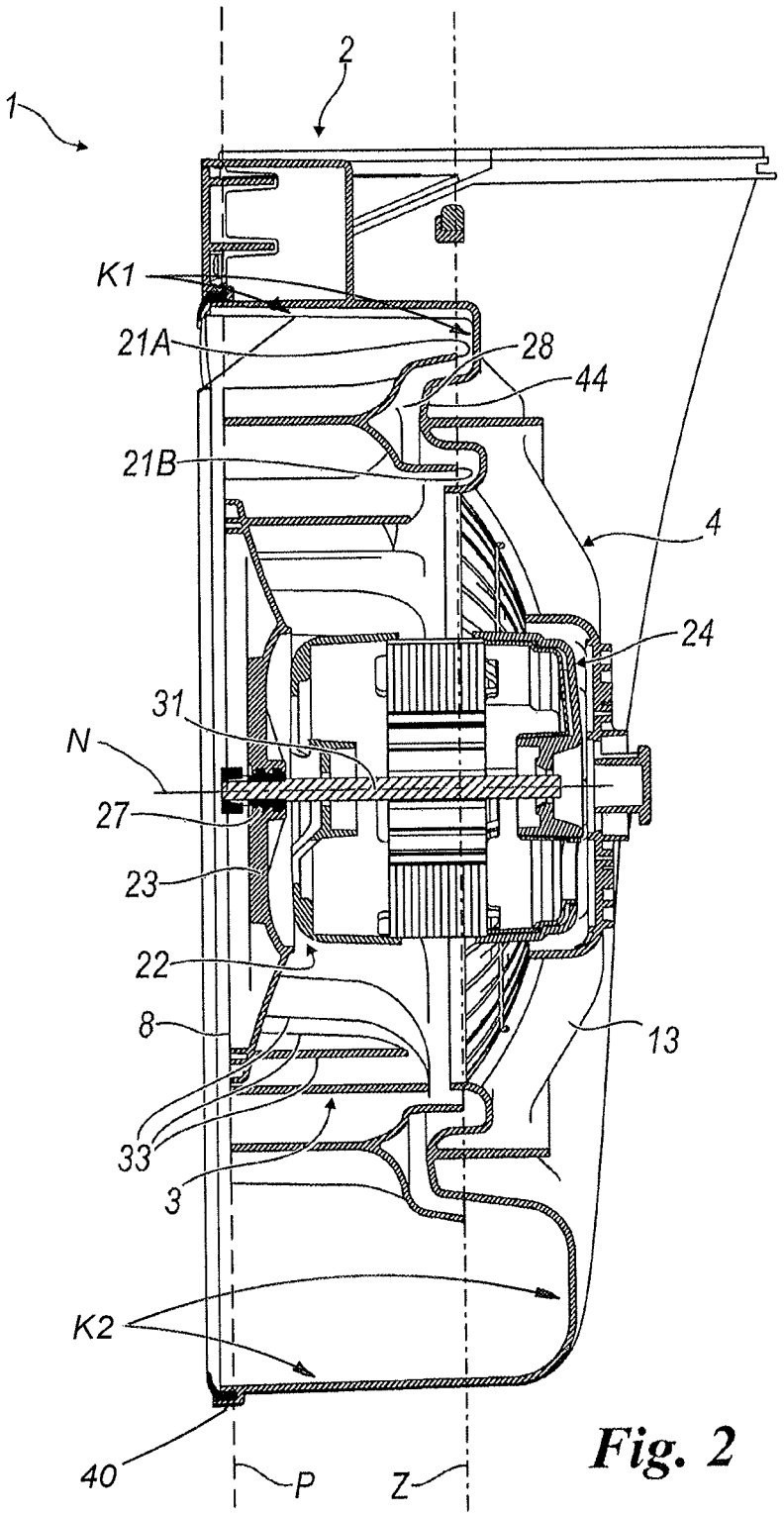
FIG. 2 shows a cross-section of the assembled fan along the line 2-2 in FIG. 1.
Figure 3:
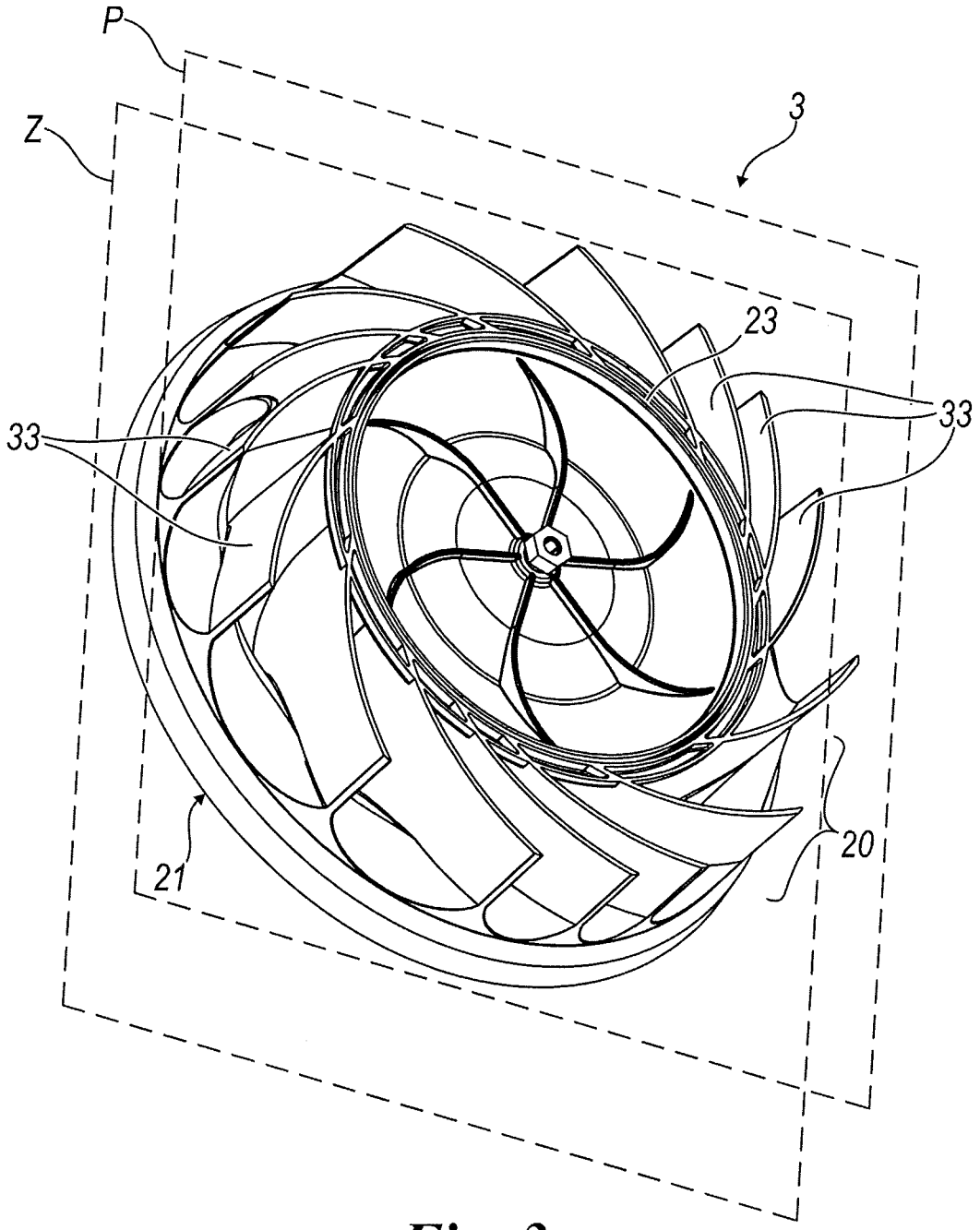
FIG. 3 shows a magnified perspective view of one side of an impeller of the fan in FIG. 1.
Figure 4:
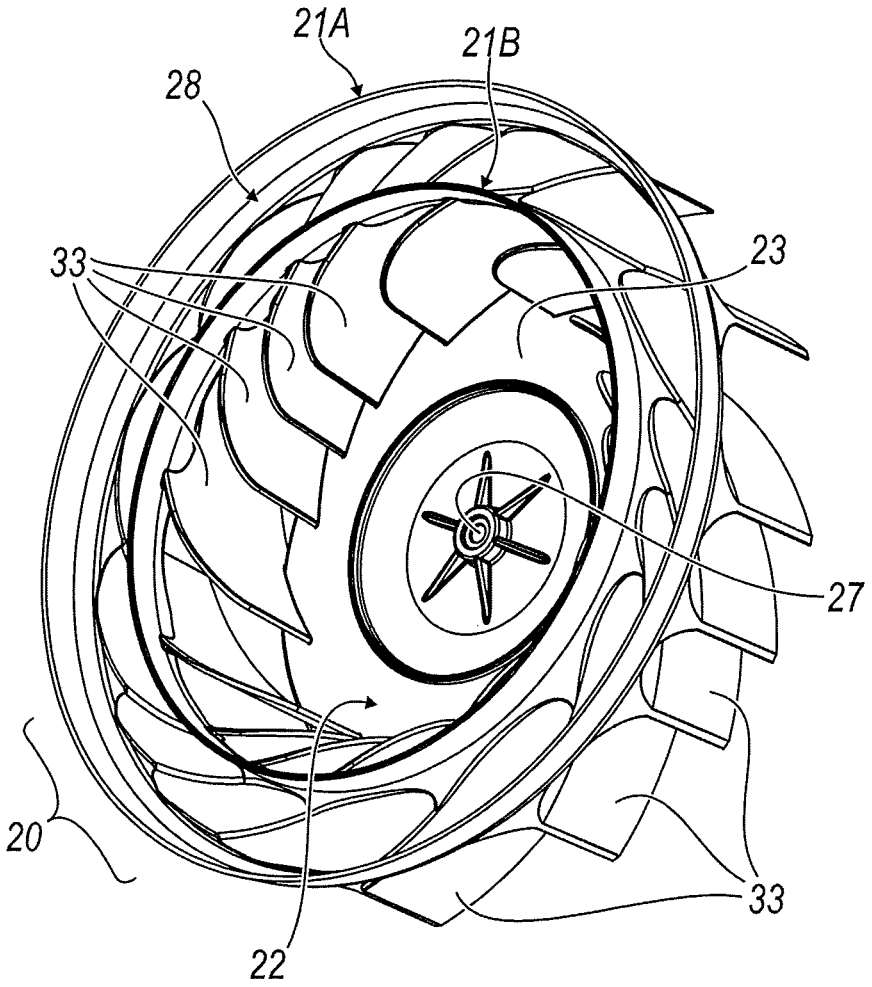
FIG. 4 shows a magnified perspective view of another side of the impeller in FIG. 3.

Perimetral part 40 has an inner edge 44 shaped in such a way as to fit within annular recess 28 of impeller 3 containing it (see FIG. 2). Air can pass through such recess. This makes it possible to limit the recycling flow of air within the diffuser, creating a kind of seal between the static part (diffuser 4) and the rotating part (impeller 3) of fan 1.

On one side of first portion 4 of diffuser 2 there is a third portion 43 of such diffuser which also delimits outlet 6 of delivery conduit 5.

Figure 1:
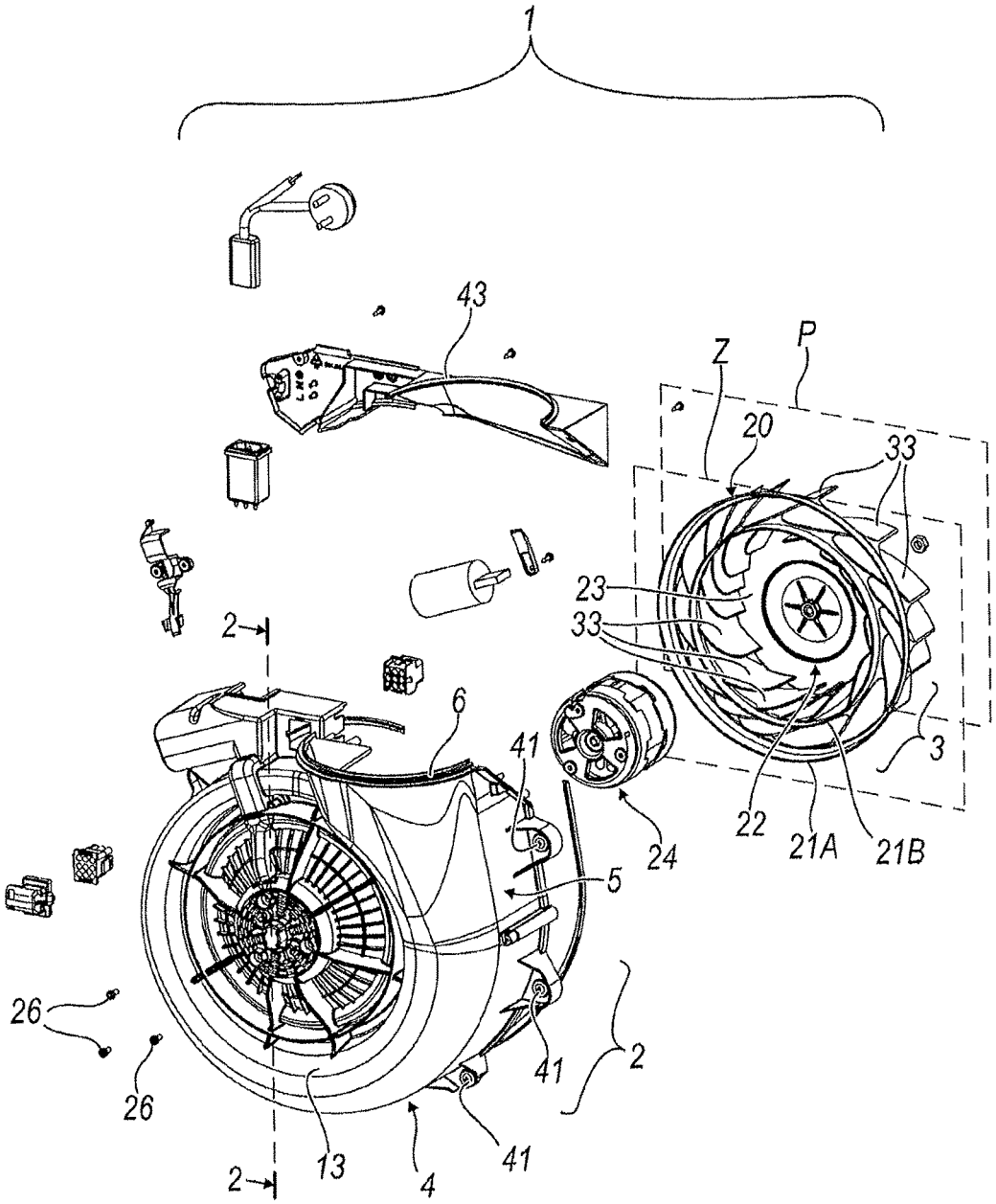
FIG. 1 shows a lateral perspective exploded view of a fan according to the invention with some parts omitted for greater clarity.

FIG. 1 also shows other known components (not numbered) which are commonly used for the electrical connections of fan 1. These components will therefore not be further described.

The fan so obtained is relatively easy to construct owing to the arrangement of the blades which are of one piece with the first and second annular portions 21A and 21B of body 20 of impeller 3, which makes moulding easier. In addition to this, the specific arrangement of the blades not only makes it possible to direct the air towards conduit 5 in an optimum way, but also makes it possible to have rotation with no or at any event little noise generation.

As the volute or diffuser also has an increasing cross-section from the inlet to conduit 5 to its extremity or outlet 6, there is optimum pressure recovery, minimising head losses, bringing about an appreciable improvement in the performance of the fan in terms of throughput, pressure and fluid dynamic efficiency. This increasing cross-section can be seen in a plurality of planes containing an axis of rotation of motor 24 or its output shaft 31; one example of a cross-section as indicated above is FIG. 2 where one of the aforesaid planes is that of the figure. From what is illustrated in FIG. 2 it will be noted that cross-section K1 of the volute is smaller than cross-section K2 of that volute.

Finally it is possible to obtain a diffuser of height less than 150 mm, measured parallel to the axis of the shaft of motor 31, making it possible to reduce the height of the hood to 110 mm, with a consequent saving in the metal material of which the latter is made, and to construct an extraction system that is compact but at the same time has high efficiency.

A preferred embodiment of the invention, which is to be considered only as an example of the latter and whose characteristics are defined by the following claims, has been described.

The invention claimed is:

1. A fan (1) for a kitchen extraction hood smoke and/or vapour extraction system comprising: an impeller (3) located within a diffuser or volute (2) having connection points for attachment to the kitchen extraction hood, an electric motor (24) having an output shaft (31) that drives the impeller (3), the output shaft having an axis of rotation (N) that is common with impeller (3), said impeller (3) comprising a body (20) having a flat part (21) from which a plurality of radially arranged blades (33) extend, said blades (33) being spaced apart from each other by a variable distance according to a periodic function, the diffuser (2) has an air delivery or outlet conduit (5) having a transverse cross-section which increases from an inlet towards an outlet (6), said transverse cross-section being identified in a plurality of planes containing said axis of rotation (N) of the output shaft (31) of the electric motor (24), said conduit starting in a first portion (4) of the diffuser containing the impeller (3), said first portion (4) of the diffuser (2) contains the impeller (3) and supports the electric motor (24), and said first portion (4) of the diffuser comprises an edge (44) that extends into a recess (28) provided in the impeller (3) defined by first and second concentric annular and spaced apart portions (21A, 21B) of the body (20) of the impeller that support the blades (33), with the body including open spaces between the blades at the first and second concentric annular and spaced apart portions (21A, 21B).

2. The fan according to claim 1, wherein the first portion (4) is associated with a structure of the smoke and/or vapour extraction system.

3. The fan according to claim 1, wherein the first and second annular portions (21A, 21B) of the body (20) of the impeller (3) bound a central cavity (22) of said body which contains the electric motor (24), the blades (33) also being connected to a third portion (23) enclosing the cavity (22) in a plane (P) at a distance from a plane (Z) in which the first and second annular portions (21A, 21B) of the body (20) of the impeller (3) lie, said blades (33) supporting such third portion (23).

4. The fan according to claim 1, wherein the recess (28) present between the first annular portion (21A) and the second annular portion (21B) of the body of the impeller (3) is an open hollow space, the blades (33) of the impeller (3) being located in said hollow space.

5. A system for the extraction of smoke and/or vapours produced on a cooking surface during preparation of food, said extraction system comprising a fan according to claim 1 and a kitchen hood.

6. The fan according to claim 1, wherein the first annular portion (21A) is located in an area of the diffuser (2) that has the transverse cross-section which increases from an inlet towards an outlet (6).

7. The fan according to claim 6, wherein the diffuser includes an edge (44) that extends between the first and second annular portions (21A, 21B) of the body (20) of the impeller (3).

* * * * *